United States Patent [19]

Hasui et al.

[11] 4,132,286

[45] Jan. 2, 1979

[54] MUFFLER

[75] Inventors: Hiroshi Hasui, Tokyo; Eizo Suyama, Mitaka, both of Japan

[73] Assignee: Nihon Radiator Co., Ltd.

[21] Appl. No.: 827,548

[22] Filed: Aug. 25, 1977

[30] Foreign Application Priority Data

Aug. 31, 1976 [JP] Japan ..... 51/103124
Aug. 31, 1976 [JP] Japan ..... 51/103125

[51] Int. Cl.[2] ..... F01N 1/00
[52] U.S. Cl. ..... 181/265; 181/269
[58] Field of Search ..... 181/265, 269, 270, 272, 181/275, 255, 264

[56] References Cited

U.S. PATENT DOCUMENTS 2,787,119 4/1957 Giambruno ..... 181/264

*Primary Examiner*—Donald G. Kelly
*Attorney, Agent, or Firm*—Gordon W. Hueschen

[57] ABSTRACT

A muffler comprising: an upper case provided at the opposite ends with semi-cylindrical inlet and outlet sections respectively and having an outwardly raised central portion and an integral flange-like edge portion; a lower case joined at a flange-like edge portion to that of said upper case and substantially symmetrical with said upper case with respect to the underside thereof; an exhaust inlet tube forming member having at least a semi-cylindrical inlet section inserted in a cylindrical inlet formed by the inlet sections of said upper and lower cases joined together and a gutter-like guide section connected to said inlet section and being joined to said upper case, lower case or both of them, said forming member being provided adjacent to an end thereof with a perforated portion; and an exhaust outlet tube forming member having at least a semi-cylindrical outlet section fitted in a cylindrical outlet formed by the outlet sections of said upper and lower cases and a gutter-like guide section connected to said outlet section and being joined to said upper case, lower case or both of them; the exhaust inlet and outlet tubes formed in this way within the muffler body being communicated with each other through an exhaust gas passage formed between the outer surface of said individual component parts and the inner surface of said case and also through said passage, the end of said outlet tube being positioned behind the leading end of said inlet tube.

27 Claims, 13 Drawing Figures

MUFFLER

BACKGROUND OF THE INVENTION

1. Field of the Invention

This invention relates to a muffler and, more particularly, to a muffler for muffling exhaust sound of an internal combustion engine such as an engine for a motor vehicle.

2. Prior Art

A conventional muffler has been constructed by inserting an exhaust inlet tube and an outlet tube in a cylindrical or elliptical barrel and providing partition walls and shortcircuit tubes within the barrel for uniformalizing the pulsation pressure introduced into the muffler. However, such muffler has a number of component parts, and also its assembly operation is extremely complicated. Therefore, high manufacturing cost has been inevitable. More particularly, at the time of assembly fabrication of the barrel by seam welding, the operation of fastening and coupling the barrel and opposite end plates, the operation of coupling a perforated partition member partitioning the interior of the muffler body into two compartments and a barrel by bolting or spot welding, and welding and other operation for inserting the exhaust inlet tube and outlet tube into the body and supporting the resultant assembly are required, and also these operations have been carried out through complicated sequential steps.

3. Object of the Invention

An object of the invention is to provide a novel muffler.

Another object of the invention is to provide a muffler, which can be constructed by pressing a comparatively simple metal plate and welding operation.

A further object of the invention is to provide a muffler, in which all component parts can be formed by pressing process, and which can be constructed by easy assembly operation and is at least equal in operation and effect to the conventional barrel type muffler.

SUMMARY OF THE INVENTION

These objects can be achieved by a muffler comprising: an upper case provided at the opposite ends with semi-cylindrical inlet and outlet sections respectively and having an outwardly raised central portion and an integral flange-like edge portion; a lower case joined at a flange-like edge portion to that of said upper case and substantially symmetrical with said upper case with respect to the underside thereof; an exhaust inlet tube forming member having at least a semi-cylindrical inlet section inserted in a cylindrical inlet formed by the inlet sections of said upper and lower cases joined together and a gutter-like guide section connected to said inlet section and being joined to said upper case, lower case or both of them, said forming member being provided adjacent to an end thereof with a perforated portion; and an exhaust outlet tube forming member having at least a semi-cylindrical outlet section fitted in a cylindrical outlet formed by the outlet sections of said upper and lower cases and a gutter-like guide section connected to said outlet section and being joined to said upper case, lower case or both of them; the exhaust inlet and outlet tubes formed in this way within the muffler body being communicated with each other through an exhaust gas passage formed between the outer surface of said individual component parts and the inner surface of said case and also through said passage, the end of said outlet tube being positioned behind the leading end of said inlet tube.

Thus, according to the invention an automotive silencer which can be constructed by a comparatively simple metal plate press forming operation and welding operation, can be obtained.

BRIEF DESCRIPTION OF THE INVENTION

DETAILED EXPLANATION OF THE INVENTION

Figure 1:
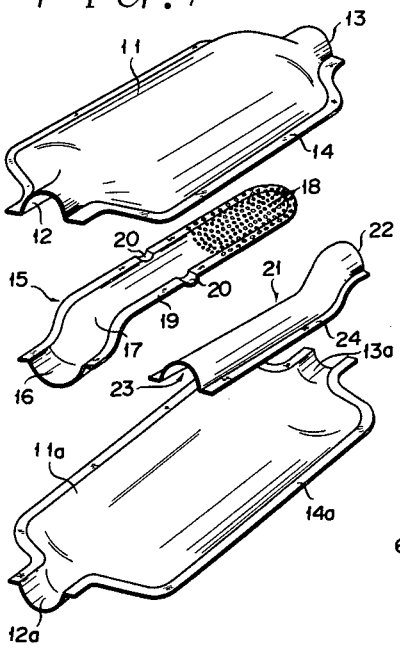
FIG. 1 is an exploded perspective view showing an embodiment of a muffler in accordance with the present invention.
Figure 2:
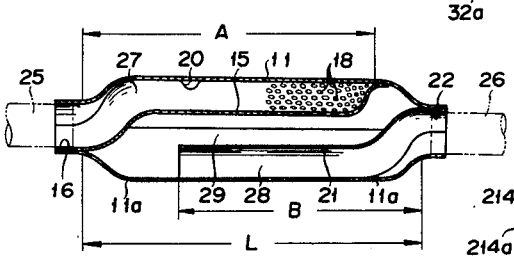
FIG. 2 is a sectional view showing the muffler shown in FIG. 1 after assembly.
Figure 12:
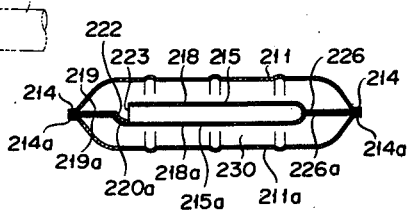
FIG. 12 is a sectional view taken along line XII-XII in FIG. 10 similar to FIG. 11.

Component parts of a muffler shown in FIGS. 1 to 2 can be readily manufactured by press working a metal plate. In the Figure, designated at 11 and **11*a* are upper and lower cases overlapped together just like the shell of a bean-jam wafer to form a body of a muffler. The cases are provided at the respective opposite end portions with semi-cylindrical inlet sections 12 and 12*a* and outlet sections 13 and 13*a* and have respective flange-like edge portions 14 and 14*a*. The upper case 11 has an outwardly (upwardly) raised central portion, and the lower case 11*a* also has an outwardly (downwardly) raised central portion. Designated at 15 is a groove-shaped guide piece provided at an end with a semi-cylindrical inlet portion 16 inserted into the inlet section 12*a* of the lower case 11*a* and has a grooved portion 17 connected to the inlet portion 16 and terminating in a closed and perforated end portion. It also has a flange-like edge portion 19 which is attached to the inner surface of the upper case 11 and is provided with a passage constituted by recesses formed in intermediate opposite side positions. Designated at 21 is a guide piece provided at an end with a semi-cylindrical outlet section 22 inserted into the outlet section 13 of the upper case 11 and has a grooved portion 23** connected to the outlet portion 22 and having an open end. It also has a flange-like edge portion 24 which is attached to the inner surface of the lower case 11*a*.

The inlet section 12*a* of the lower case 11*a* is fitted, with the inlet section 16 of the guide piece 15 fitted in it, together with the inlet section 12 of the upper case 11 on an engine exhaust tube 25. Meanwhile, the outlet section 13 of the upper case 11 is fitted, with the inlet section 22 of the guide piece 21 fitted in it, together with the outlet section 13*a* of the lower case 11*a* on an exhaust tube 26. Therefore, the inlet section 12*a* and outlet section 13*a* are made slightly greater than the respectively opposing inlet section 12 and outlet section 13.

To assemble this muffler, the guide piece 15 is secured to the upper case 11 by spot welding its flange-like portion 19 held in contact with the inner surface of the upper case, the flange-like portion 24 of the guide piece 21 is similarly spot welded to the lower case 11*a*, and then the upper and lower cases 11 and 11*a* are coupled together by seam welding the flangelike portions 14 and 14*a*, inlet sections 12 and 12*a* and outlet sections 13 and 13*a*. In this way, the muffler is assembled into the state as shown in FIG. 2, and then it is coupled to the exhaust tubes 25 and 26.

In this muffler, space 27 defined by the guide piece 15 and upper case 11 constitutes an exhaust inlet tube, with a number of small holes 18 positioned in the closed end portion of the inlet tube and passages 20 constituting a shunting hole. Space 28 defined by the guide piece 21 and lower case 11*a* constitutes an exhaust outlet tube. The ratio A : B of the length A of intrusion of the inlet tube into the body of the muffler of length L formed in this way to the length B of intrusion of the outlet tube is effectively set to $\frac{1}{2}$ L : $\frac{1}{4}$ L, $\frac{3}{4}$ L : $\frac{1}{2}$ L, or $\frac{1}{2}$ L : $\frac{3}{4}$ L. The size and quantity of the shunting hole 20 are effectively set such that when the diameter of the inlet tube is 40 mm, an equivalent area within a range corresponding to four shunting holes with a diameter of 2 mm to two shunting holes with a diameter of 6 mm is provided.

In the muffler constituted in this way, the exhaust gas from the engine enters through the exhaust tube 25 into the space 27 within the guide piece 15 and then enters through the small holes 18 in the end portion into a space 29 enclosed by the upper and lower cases 11 and 11*a* for expansion. Then, after compression it enters through an opening at the end portion of the guide piece 21 into the space 28 within the guide piece 21, and then it flows out through the exhaust tube 26. The passages 20 are provided to the end of permitting part of the exhaust gas to be exhausted without passing through the small holes 18 so as to prevent high engine back pressure due to the resistance offered by the small holes 18.

With this construction of the muffler, a novel muffler providing comparable or superior effects with respect to the conventional construction can be manufactured far more readily compared to the conventional muffler construction by a method comprising a simple main press formation and slight additional welding operation.

Figure 3:
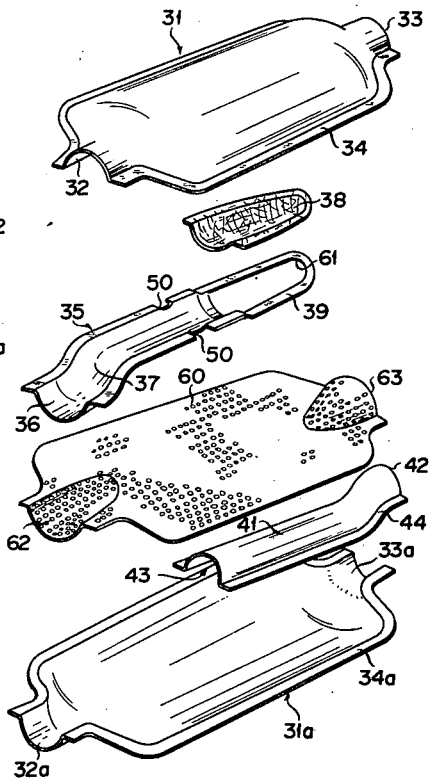
FIG. 3 is an exploded perspective view showing another embodiment of the muffler in accordance with the present invention.
Figure 4:
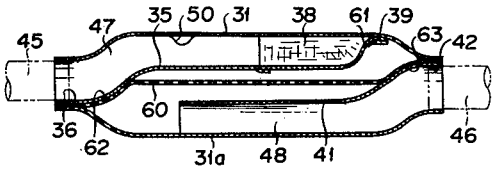
FIG. 4 is a sectional view showing the muffler shown in FIG. 3 after assembly.

FIGS. 3 and 4 show another embodiment of the invention. In the Figure, designated at 31 and 31*a* are upper and lower cases overlapped over each other to form a muffler body. These cases are provided at the opposite ends with respective semicylindrical inlet sections 32 and 32*a* and outlet sections 33 and 33*a* and have respective flange-like edge portions 34 and 34*a*. Both cases 31 and 31*a* have respective outwardly raised portions. In lieu of the guide piece 15 provided at the end portion with small holes 18 in the muffler of FIGS. 1 and 2, a porous molding 38 is provided, and also a perforated partition wall 60 for preventing the noise of generation of a jet issuing from the porous body 38 is provided. For the porous molding 38, use may be made of foamed metals having continuous pores, metal nets and the like.

In this embodiment, a guide piece 35 provided at the end with a semi-cylindrical inlet section 36 and having a grooved portion 37 united to the inlet section 36 and a flange-like edge portion 39 to be applied to the inner surface of the upper case 31 as in the case of FIGS. 1 and 2 is formed at the other end portion with a hole 61 surrounded by the flange-like edge portion 39, and the porous molding 38 having a flange-like edge portion conforming to that of the guide piece 35 proper is fitted therein before the guide piece is coupled to the upper case 11. The guide piece 35 is provided at its intermediate portion with a passage 50 formed by cutting channel-like notches in the flange-like edge portion 39. Further, a guide piece 41, which is provided at an end with a semi-cylindrical outlet section 42 and has a grooved portion 43 united to said outlet section 42 and open at the other end, has its flange-like edge portion 44 applied to the inner surface of the lower case 31*a*. A perforated member 60 is interposed between both the guide pieces 35 and 41. In order that a step difference should not occur between the perforated molding 38 and guide piece 35, the corresponding end portion of the flange-like edge portion 39 is made lower in level to an extent equal to the thickness of the flange-like edge portion of the molding 38. The perforated member 60 is provided at the opposite ends with semi-cylindrical inlet and outlet sections 62 and 63 fitted together with respective guide pieces 35 and 41 in the inlet section 32*a* and outlet section 33 of the cases respectively. Since the inlet section 62 of the perforated member 60 and the inlet section 36 of the guide piece 35 are fitted in the inlet section 32*a* of the lower case 31*a* while the outlet section 63 of the perforated member 60 and the outlet section 42 of the guide piece 41 are fitted in the outlet section 33 of the upper case 31, the inlet and outlet sections 32*a* and 33 are made greater in size than the respectively corresponding inlet and outlet sections 32 and 33*a* of the upper and lower cases.

The muffler of this construction has its inlet fitted on an engine exhaust tube 45 and its outlet fitted on an exhaust tube 46. A major proportion of the exhaust gas entering from the exhaust tube 45 into the space 47 within the guide piece 35 issues from the fine pores of the porous molding 38. The noise occurring at this time is attenuated as the exhaust gas passes through the perforated member 60, and thereafter the exhaust gas enters the space 48 within the guide piece 41 and flows out into the exhaust tube 46.

With this construction of the muffler, it is possible to readily manufacture a novel muffler having comparable or superior effects with respect to the conventional construction by a method comprising a main simple press forming operation and slight welding operations.

Figure 6:
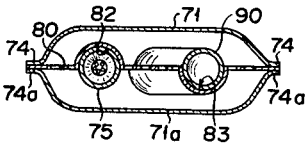
FIG. 6 is a sectional view of the muffler shown in FIG. 5 after assembly.
Figure 5:
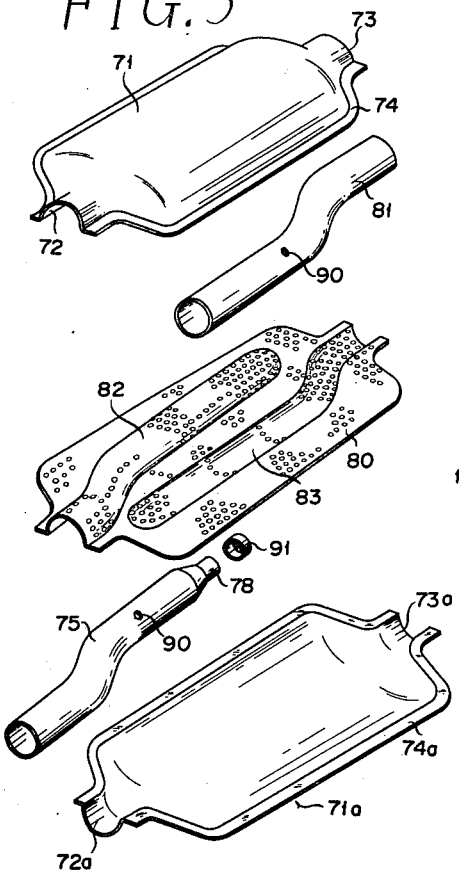
FIG. 5 is an exploded perspective view showing a still further embodiment of the muffler in accordance with the present invention.

FIGS. 5 and 6 show a further embodiment of the invention. In the Figure, designated at 71 and 71*a* are upper and lower cases overlapped over each other to form a muffler body. These cases are provided at the opposite ends with respective semi-cylindrical inlet sections 72 and 72*a* and outlet sections 73 and 73*a* and have respective flange-like edge portions 74 and 74*a*. Both cases have respective outwardly raised portions. This muffler uses, in lieu of the gutter-like guide pieces in the mufflers of FIGS. 1 to 4, an inlet tube 75 curved to conform to the lower case 71*a* and an outlet tube 81 curved to conform to the upper case 71. The inlet tube 75 is provided at its tip with a reduced-diameter portion 78, on which a cap 91 of a foaming metal having continuous pores, a metal net or the like material is fitted. It is also provided with a shunting hole 90. The outlet tube 81 is also provided with a shunting hole 90. These inlet and outlet tubes 75 and 81 are secured by welding to the respective lower and upper cases 71*a* and 71 by means of a perforated member 80 having grooves 82 and 83 receiving them.

With this construction of the muffler, the engine exhaust gas is throttled in the reduced-diameter portion 78 and passes ghrough the fine pores in the cap 91 to be issued into the interior of the muffler body. The noise occurring at this time is attenuated as the exhaust gas passes through the perforated member 80, and thereafter the exhaust gas enters the outlet tube 90 to be exhausted. Meanwhile, part of the exhaust gas passes through the shunting hole 90, whereby increase of the engine back pressure can be prevented. This muffler again can be readily manufactured by press operation and also has comparable or superior effects with respect to the conventional construction.

Figure 7:
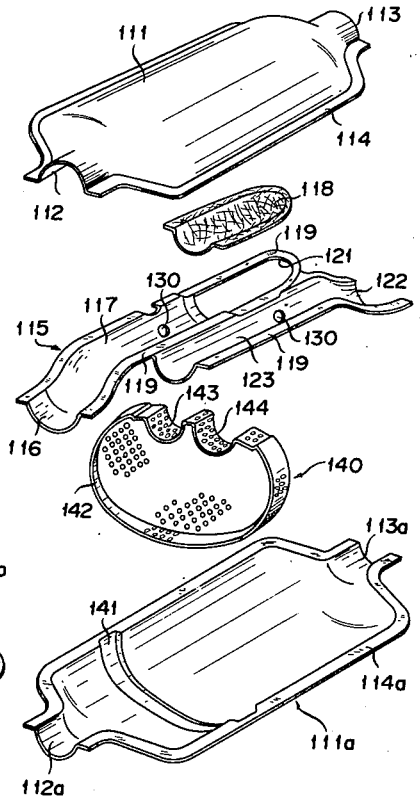
FIG. 7 is an exploded perspective view of a yet further embodiment of the muffler in accordance with the present invention.
Figure 8:
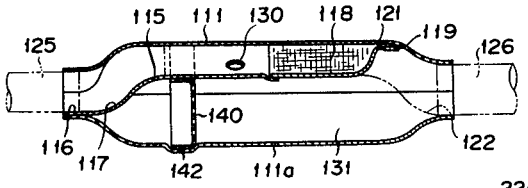
FIG. 8 is a sectional view of the muffler shown in FIG. 7 after assembly.
Figure 10:
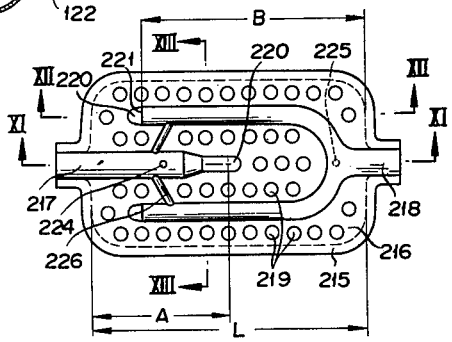
FIG. 10 is a plan view showing the muffler shown in FIG. 9 with the upper case removed.
Figure 9:
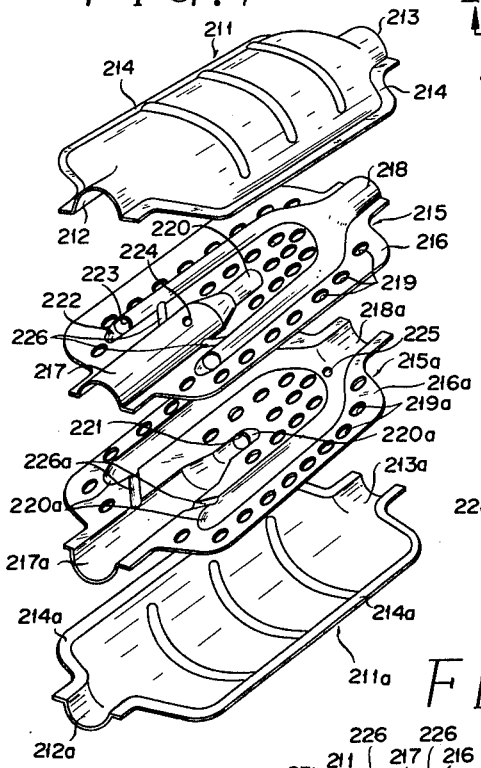
FIG. 9 is an exploded perspective view showing a further embodiment of the muffler in accordance with the present invention.
Figure 11:
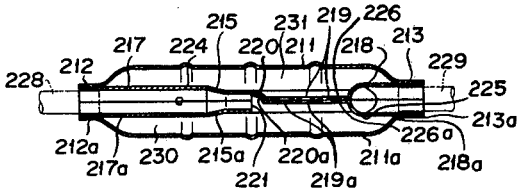
FIG. 11 is a sectional view taken along line XI-XI in FIG. 10 showing the muffler after assembly with the upper case mounted.
Figure 13:
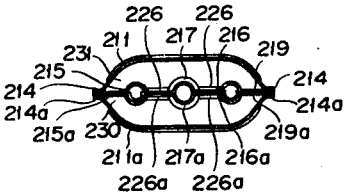
FIG. 13 is a sectional view taken along line XIII-XIII in FIG. 10 similar to FIG. 11.

FIGS. 7 and 8 show a further embodiment of the invention. In this embodiment, a perforated plate assembly 140 in the form like a partition wall extending normal to the flow path is used in lieu of the perforated member 60 in the embodiment of FIGS. 3 and 4. Also, in this case the guide pieces 35 and 41 are replaced with a single guide piece 115 formed by press stamping and adapted to be affixed to the upper case 111. Upper and lower cases 111 and 111*a*, which are overlapped over each other to form the muffler body, are provided at the opposite ends with respective semi-cylindrical inlet sections 112 and 112*a* and semi-cylindrical outlet sections 113 and 113*a* and have respective flange-like edge portions 114 and 114*a*. These cases have their central portions outwardly raised by press stamping. The lower case 111*a* is further provided with a groove 141 for receiving the preforated plate assembly 140. The perforated plate assembly 140 is provided with a flange 142 and recesses 143 and 144 for receiving the guide piece 115. The guide piece 115 has a shape corresponding to what is obtained by arranging the guide pieces 35 and 41 of the gutter-like form shown in FIGS. 3 and 4 side by side and with their grooves both directed upwards. Its gutter-like inlet section 117 is provided at the end portion with a hole 121 enclosed within flange-like edge portion 119 similar to the case of FIGS. 3 and 4, and a porous molding 118 conforming to the hole 121 thus formed and having a flange-like edge portion is fitted in the hole 121. The guide piece 115 has a flange portion 119 provided along its edge and also along its longitudinal center. Its gutter-like portion 117 formed between the flange portion 119 along the edge of one side and that along the longitudinal center is provided at one end with an inlet section 116 fitted in the inlet section 112*a* of the lower case 111*a*, while its gutter-like portion 123 formed between the flange portion 119 along the edge of the other side and that along the longitudinal center and extending parallel to the afore-mentioned gutter-like portion 117 is open at the end nearer the inlet section 112*a* and is provided at the other end with an outlet section 122 fitted in the outlet section 113*a* of the lower case 111*a*. In order that no step difference should result between the guide piece 115 and the porous molding 118, the corresponding end portion of the flange portion 119 of the guide piece 115 is made lower in level by an amount corresponding to the thickness of the flange-like edge portion of the molding 118. The gutter-like portions 117 and 122 are provided with respective shunting holes 130. FIG. 8 shows the muffler assembled from the above component parts.

The muffler of this construction has its inlet fitted on an engine exhaust tube and its outlet fitted on an exhaust tube. The exhaust gas entering from the exhaust tube 125 into the guide section 117 enters through the porous molding 118 and shunting hole 130 into the space 131 in the body on the right hand side of the perforated plate assembly 140, and then it enters from the opening of the guide section at the left hand end thereof into the guide section 123 and is discharged through the following exhaust tube 126. This muffler again can be readily manufactured by press operation and also has comparable or superior effects with respect to the conventional construction.

In the preceding embodiments, the length of the guide piece inserted in each case and the size of the shunting hole are determined in the manner as has been described in connection with the muffler as shown in FIGS. 1 and 2.

FIGS. 9 to 13 show a further embodiment of the invention. The individual cases and partition members are manufactured by press forming respective steel plates. Upper and lower cases 211 and 211*a* are symmetrical with respect to the boundary plane. They have respective raised central portions, and also they are provided at one end with respective semi-cylindrical inlet sections 212 and 212*a* and at the other end with respective semi-cylindrical outlet sections 213 and 213*a* and have respective flange-like edge portions 214 and 214*a*. Upper and lower partition members 215 and 215*a* are symmetrical with respect to their boundary plane except for inlet tube section, flow tube section and inner end to be described later in detail. The partition members 215 and 215*a* include respective plate-like stem portions 216 and 216*a* of the same size as the flange-like edge portions of the cases 211 and 211*a*. The stem portions 216 and 216*a* are provided with semi-cylindrical inlet tubes 217 and 217*a* extending from their one end (left hand end in FIG. 9) and fitted in the respective inlet sections 212 and 212*a* of the upper and lower cases 211 and 211*a*, with the inlet tube thus formed being tapered toward the inner end, and semi-cylindrical outlet tubes 218 and 218*a* similarly extending from their other end (right hand end in FIG. 9) and fitted in the respective outlet sections 213 and 213*a* of the upper and lower cases 211 and 211*a*, with the outlet tube thus formed having a bifurcated portion. These stem portions 216 and 216*a* are formed in portion other than portions overlapped over the flange portions 214 and 214*a*, inlet tube sections 217 and 217*a* and outlet tube sections 218 and 218*a* with a number of small holes 219 and 219*a*. The inner end section 220*a* of the inlet tube section 217 is closed, and the inner end 220 of the other inlet tube section 217*a* is bent upright in a form to be fitted in said inner end 220 and provided with an opening (see FIGS. 9 and 11). In the case of the outlet sections 218 and 218*a*, conversely, the inner ends 222*a* of the outlet tube section 218*a* are closed, and the inner ends 222 of the other are bent upright and provided with openings 223 (see FIGS. 9 and 12). The inlet and outlet tube sections 217 and 218*a* are provided with respective shunting holes 224 and 225, and semi-cylindrical shunting tube sections 226 and 226a are provided respectively between the inlet tube sections 217 and 217a and between the outlet tube sections 218 and 218a.

The ratio A : B of the length A of intrusion of the inlet tube section 217 into the muffler body to the length B of intrusion of the outlet tube section 218 is adapted such that the actual acoustical length is constructed to a combination of $\frac{1}{2}$ L : $\frac{1}{4}$ L or $\frac{1}{2}$ L : $\frac{3}{4}$ L with respect to the total length L by taking the shunting holes into consideration. Regarding the shunting holes 224 and 225, when the diameter of the individual tubes 217 and 218 are 40 mm, effective muffling can be obtained with four holes of a diameter of 2 mm or with two holes with a diameter of 6 mm.

In the assembly, an exhaust inlet tube 228 from an engine (not shown) and an exhaust outlet tube 229 are clamped between the outer ends of the semi-cylindrical inlet tube sections 217 and 217a and also between the outer ends of the outlet tube sections 218 and 218a. Then, the upper and lower cases 211 and 211a and upper and lower partition members 215 and 215a are overlapped into the state as shown in FIGS. 10 to 13, and overlap portions of the flange portions 214 and 214a and contact portions of the inlet and outlet tubes 228 and 229 with respect to the muffler body are joined together by seam welding.

The muffler assembled in this way in accordance with the present invention has its body constituted by the upper and lower cases 211 and 211a, and also it has two, namely upper and lower, sections or compartments 231 and 230 defined by the perforated partition members 211 and 211a, which also form inlet and outlet tubes open to respectively separate sections.

The exhaust gas flowing from the exhaust inlet tube 228 into the muffler body flows in the following manner to be given various muffling effects by individual component parts. Namely, major proportion of the inlet tube sections 217 and 217a passes through the inlet tube sections 217 and 217a and enters from the opening 221 into the lower section 230. Part of the exhaust gas flows from the inlet tube section through shunting holes 224 and shunting tubes 226 and 226a directly into the upper section 231 and outlet tube sections 218 and 218a. A major proportion of the exhaust gas from the section 230 flows through a number of small holes 219 and 219a into the upper section 231, while part of the exhaust gas flows directly through the shunting hole 225 into the outlet tube sections 218 and 218a. The exhaust gas from the upper section flows through the two openings 223 into the outlet tube sections 218 and 218a and thence it is exhausted into the outlet tube 229.

By setting the diameter of the small hole 219 to 2 to 4 mm, the stem portions 216 and 216a can also serve as filter for broken catalyst particles in an upstream of a catalytic exhaust gas purifying apparatus. Also, by covering the openings 221 of the inlet tube sections 217 and 217a with a heat resistant continuous porous body or a heat resistant perforated member it is possible to prevent generation of the gas stream secondary noise issuing from the opening 221.

As has been made apparent from the embodiment shown in FIGS. 9 to 13, according to the invention it is possible to obtain various great industrial effects, namely:

(a) the construction of various muffling structures can be simplified with a reduced number of component parts;

(b) it is possible to manufacture all component parts by press forming of steel plates and obtain simpler and speedier assembly operation;

(c) since the construction is simple, it is possible to reduce the size and weight and also save the fuel consumption; and (d) a bifurcated tube can be readily provided.

What is claimed is:

1. A muffler comprising:

an upper case provided at the opposite ends with semi-cylindrical inlet and outlet sections respectively and having an outwardly raised central portion and an integral flange-like edge a lower case joined at a flange-like edge portion to that of said upper case and substantially symmetrical with said upper case with respect to the underside thereof;

an exhaust inlet tube forming member having at least a semi-cylindrical inlet section inserted in a cylindrical inlet formed by the inlet sections of said upper and lower cases joined together and a gutter-like guide section connected to said inlet section and being joined to at least one of said upper case and said lower case, said forming member being provided adjacent to an end thereof with a perforated portion; and an exhaust outlet tube forming member having at least a semi-cylindrical outlet section fitted in a cylindrical outlet formed by the outlet sections of said upper and lower cases and a gutter-like guide section connected to said outlet section and being joined to at least one of said upper case and said lower case;

the exhaust inlet and outlet tubes formed in this way within the muffler body being in communication with each other through an exhaust gas passage formed between the outer surface of said inlet and outlet tube forming members and the inner surface of said upper and lower cases, the lengths of said inlet and outlet tubes within the muffler body being in spatially overlapping relationship

2. A muffler according to claim 1, wherein said upper and lower cases are respective single pieces.

3. A muffler according to claim 1, wherein said exhaust inlet tube forming member and said exhaust outlet tube forming member are each separate from the other.

4. A muffler according to claim 3, wherein said exhaust inlet tube forming member is a guide piece provided at an end with a semi-cylindrical inlet section fitted in the inlet section of said lower case, having a gutter-like portion connected to said inlet section, closed at the other end and provided at said other end with a perforated section, and also wherein said exhaust outlet tube forming member is a guide piece provided at an end with a semi-cylindrical outlet section fitted in the outlet section of said upper case, having a gutter-like portion connected to said outlet section and open at the other end.

5. A muffler according to claim 4, wherein said exhaust inlet tube forming member is provided with a flange-like edge portion having a passage formed by depressions in intermediate portions of said edge portion, said exhaust inlet tube forming member being welded at said flange-like edge portion to said upper case, and also wherein said exhaust outlet tube forming section is provided with a flange-like edge portion and is welded at said flange-like edge portion to said lower case.

6. A muffler according to claim 3, wherein a perforated wall member is provided between said exhaust inlet tube forming member and exhaust outlet tube forming member.

7. A muffler according to claim 6, wherein said perforated wall member is provided at one end with a cylindrical inlet section fitted in the inlet section of said lower case half at the other end with a cylindrical outlet section fitted in the outlet section of said upper case and has a flange-like edge portion clamped between said upper and lower cases.

8. A muffler according to claim 7, wherein said exhaust inlet tube forming member is a guide piece provided at an end with a semi-cylindrical inlet section fitted in the inlet section of said perforated wall member, having a gutter-like portion connected to said inlet section and a flange-like edge portion integral with said gutter-like portion and formed at an end portion with a hole enclosed within said flange-like edge portion, said hole being occupied by a porous molding conforming in shape to said hole, and also wherein said exhaust outlet tube forming member is a guide piece provided at an end with a semi-cylindrical outlet section fitted in the outlet section of said perforated wall member, having a gutter-like portion connected to said outlet section open at the other end and a flange-like edge portion integral with said gutter-like portion.

9. A muffler according to claim 8, wherein said exhaust inlet tube forming member is provided with a passage formed by depressions in intermediate portion of the flange-like edge portion, a portion of the flange-like edge portion surrounding said hole at the end being lowered in level with respect to the rest of the flange-like edge portion to an extent corresponding to the thickness of the flange-like edge portion of said porous molding, said exhaust inlet tube forming member being welded at the flange-like edge portion to said upper case, said exhaust outlet tube forming member being welded at the flange-like edge portion to said lower case.

10. A muffler according to claim 8, wherein said porous molding is a foamed metal.

11. A muffler according to claim 6, wherein said exhaust inlet tube forming member is a bent tube provided at an inner end with a reduced-diameter portion, a cap having continuous pores being fitted on said reduced-diameter portion, said exhaust inlet tube forming member being formed at an intermediate portion with a shunting hole, and also wherein said exhaust outlet tube forming member is a bent tube open at the opposite ends and having a shunting hole formed at an intermediate portion.

12. A muffler according to claim 11, wherein said perforated wall member has a groove capable of being occupied by said exhaust inlet bent tube, an inlet section connected to said groove and fitted in the inlet section of said upper case, a second groove capable of being occupied by said exhaust outlet bent tube and an outlet section connected to said second groove and fitted in the inlet section of said lower case.

13. A muffler according to claim 12, wherein aid perforated wall member has the edge portion thereof welded to and clamped between the flange-like edge portions of said upper and lower cases, said exhaust inlet bent tube having an end portion fitted in the inlet section of said lower case and a tube portion clamped between said perforated wall member and said lower case, said exhaust outlet bent tube having an end portion fitted in the outlet section of said upper case and a tube portion clamped between said perforated wall member and upper case.

14. A muffler according to claim 11, wherein said continuous pores are comprised of foamed metal.

15. A muffler according to claim 3, wherein said exhaust inlet tube forming member and said exhaust gas outlet tube forming member are constituted by a single integral guide piece.

16. A muffler according to claim 15, wherein said guide piece comprises two parallel gutter-like portions respectively forming the exhaust inlet and outlet tubes and has a flange portion extending along the edge and also along a longitudinal center, said inlet tube forming gutter-like portion being provided at an end with an inlet section fitted in the inlet section of said lower case and at the other end with an opening surrounded by said flange portion and occupied by a porous molding conforming in shape to said opening and having a flange-like edge portion, said outlet tube forming gutter-like portion being open at an end are provided at the other end with an outlet section fitted in the outlet section of said lower case.

17. A muffler according to claim 16, wherein said inlet and outlet tube forming gutter-like portions are provided with respective shunting holes, and also wherein a portion of said flange portion surrounding said opening at the end is lowered in level with respect to the rest of said flange portion to an extent corresponding to the thickness of the flange-like edge portion of said porous molding, said guide piece being welded at said flange portion to said upper case.

18. A muffler according to claim 17, wherein said exhaust inlet tube end opening and said exhaust outlet tube end opening are communicated with each other through said porous member.

19. A muffler according to claim 18, wherein said porous member has a flange-like edge portion having a lower portion received in a recess formed in said lower case.

20. A muffler according to claim 15, wherein said exhaust inlet tube forming member and exhaust gas outlet tube forming member in the integral combination comprise upper and lower partition members.

21. A muffler according to claim 20, wherein said upper partition member comprises a plate-like stem portion of an outer shape having the same size as a flange-like edge portion of said upper and lower cases and is provided with a semi-cylindrical exhaust inlet tube section extending from one end of said stem portion and fitted in the inlet section of said upper case, the inner end of said exhaust inlet tube section being closed, said stem portion being also provided with a semi-cylindrical exhaust gas outlet tube section extending from the other end of said stem portion and fitted in the outlet section of said upper case, said semi-cylindrical exhaust inlet tube section having a bifurcated inner portion closed at the inner end, said plate-like stem portion being provided in a portion thereof other than the portion overlapped over the flange portion and said exhaust gas inlet and outlet sections with a number of small holes, and also wherein said lower partition member comprises a plate-like stem portion of an outer shape having the same size as the flange-like edge portion of said upper and lower cases and is provided with a semi-cylindrical exhaust inlet tube section extending from one end of said stem portion and fitted in the inlet section of said lower case, the inner end of said exhaust outlet tube section being open, said stem portion being also provided with a semi-cylindrical exhaust gas outlet tube section extending from the other end of said lower case and fitted in the outlet section of said lower case, said semi-cylindrical exhaust outlet tube section having bifurcated inner portion closed at the inner end, said plate-like stem portion being formed in a portion thereof other than the portion overlapped over the flange portion and said exhaust inlet and outlet sections with a number of small holes.

22. A muffler according to claim 21, wherein said exhaust inlet and outlet tube sections are provided with respective shunting holes.

23. A muffler according to claim 21, wherein a semi-cylindrical shunting section is provided in each of said upper and lower partition members between said exhaust inlet and outlet tube sections.

24. A muffler according to claim 21, wherein said upper and lower partition members are welded to and clamped between the flange-like edge portions of said upper and lower cases.

25. A muffler according to claim 8, wherein said porous molding is a metal net.

26. A muffler according to claim 11, wherein said continuous pores are comprised of a metal net.

27. A muffler comprising:

an upper case provided at the opposite ends with semi-cylindrical inlet and outlet sections respectively and having an outwardly raised central portion and an integral flange-like edge portion;

a lower case joined at a flange-like edge portion to that of said upper case and substantially symmetrical with said upper case with respect to the underside thereof;

an exhaust inlet tube forming member having at least a semi-cylindrical inlet section inserted in a cylindrical inlet formed by the inlet sections of said upper and lower cases joined together and a guide section connected to said inlet section and being joined to said upper case when said guide section is semi-cylindrical and to both said cases when said guide section is other than semi-cylindrical, said forming member being provided adjacent to an end thereof with a perforated portion; and an exhaust outlet tube forming member having at least a semi-cylindrical outlet section fitted in a cylindrical outlet formed by the outlet sections of said upper and lower cases and a guide section connected to said outlet section and being joined to said lower case when said guide section is semi-cylindrical and independent of said inlet tube forming member and to both said cases when said guide section is other than semi-cylindrical;

the exhaust inlet and outlet tubes formed in this way within the muffler body being in communication with each other through an exhaust gas passage formed between the outer surface of said inlet and outlet tube forming members and the inner surface of said upper and lower cases, the lengths of said inlet and outlet tubes within the muffler body being in spatially overlapping relationship.

* * * * *

UNITED STATES PATENT AND TRADEMARK OFFICE

CERTIFICATE OF CORRECTION

PATENT NO. : 4,132,286

DATED : January 2, 1979

INVENTOR(S) : Hasui et al.

It is certified that error appears in the above-identified patent and that said Letters Patent are hereby corrected as shown below:

[75] Inventors; "Mitaka," should read -- Tokyo --

Col. 5, line 15; "ghrough" should read -- through --
Col. 5, line 42; "preforated" should read -- perforated --
Col. 8, line 13; the word "portion" is left out.

Col. 8, line 41; "relationship" should have a period after it -- relationship. --

Col. 9, line 61; "aid" should read -- said --

Signed and Sealed this

*Eighth* Day of *May 1979*

[SEAL]

*Attest:*

RUTH C. MASON
*Attesting Officer*

DONALD W. BANNER
*Commissioner of Patents and Trademarks*